United States Patent [19]

Katz

[11] 4,060,385

[45] Nov. 29, 1977

[54] METHOD FOR HYDROGEN PEROXIDE BLEACHING IN ACID OR NEUTRAL SOLUTIONS

[76] Inventor: Jerome Katz, P.O. Box 1544, Rochester, N.Y. 14603

[21] Appl. No.: 609,734

[22] Filed: Sept. 2, 1975

Related U.S. Application Data

[63] Continuation-in-part of Ser. No. 312,637, Dec. 6, 1972, Pat. No. 3,918,898.

[51] Int. Cl.[2] ..... D06L 3/02

[52] U.S. Cl. ..... 8/111; 252/95; 252/186

[58] Field of Search ..... 8/111; 252/186, 95

[56] References Cited

U.S. PATENT DOCUMENTS

| | | | |
|---|---|---|---|
| 2,173,474 | 9/1939 | Evoy | 8/111 |
| 2,283,141 | 5/1942 | Kauffmann et al. | 8/111 |
| 3,127,233 | 3/1964 | Lowes | 8/111 |
| 3,193,445 | 7/1965 | Parker et al. | 8/111 |
| 3,345,303 | 10/1967 | Schmid et al. | 8/111 |
| 3,686,126 | 8/1972 | Smeets | 252/99 |
| 3,756,774 | 9/1973 | Kirner | 8/111 |

FOREIGN PATENT DOCUMENTS

| | | | |
|---|---|---|---|
| 466,112 | 5/1937 | United Kingdom | 8/111 |

*Primary Examiner*—William E. Schulz
*Attorney, Agent, or Firm*—Stuart J. Friedman

[57] ABSTRACT

A process for scouring, desizing and bleaching cotton greige goods comprising immersing the goods for a time sufficient to achieve commercial brightness in an aqueous solution having a temperature in the range from 100° to 212° F and consisting of from 3 to 70% of volume hydrogen peroxide, water and sufficient hydroxide, if necessary, to adjust the solution of a pH in the range 2 to 7, the solution being substantially free of heavy metal ions and maintained out of contact with all metals while the goods are immersed therein and cycling a portion of the solution through a filtration means to remove solid impurities therefrom while maintaining the volume, composition and pH of the solution in contact with the goods substantially the same. In a preferred form of the invention, the scouring, desizing and bleaching are accomplished simultaneously. In another embodiment of the invention, the goods are immersed in alkaline scour solution for from 5 seconds to 3½ minutes prior to bleaching in the hydrogen peroxide solution, the alkaline scour solution having a temperature in the range 160° to 212° F and a pH from 10 to 14. In still another embodiment of the invention, the goods are immersed in an alkaline scour solution and an acid solution, in any sequence, prior to bleaching in the hydrogen peroxide solution.

32 Claims, 6 Drawing Figures

METHOD FOR HYDROGEN PEROXIDE BLEACHING IN ACID OR NEUTRAL SOLUTIONS

This is a continuation-in-part of my presently co-pending application Ser. No. 312,637, filed Dec. 6, 1972 and now U.S. Pat No. 3,918,898.

The present invention relates to hydrogen peroxide bleaching of cotton greige goods and, more particularly, to bleaching in acid or neutral bleach solutions.

Hydrogen peroxide bleaching of cotton greige goods is, of course, very well known and extensively practiced. Conventional hydrogen peroxide bleaching, whether batch of continuous, is accomplished in alkaline bleach solutions which generally exhibit a pH in excess of 10. These alkaline bleach processes are typically wasteful of bleach solution and require periodic dumping of spent bleach solutions. However, high pH spent peroxide solutions cannot be merely dumped into waterways without causing extensive environmental damage. Therefore, it has heretofore been necessary to subject the spent solutions to relatively expensive ion-exchange treatments to reduce their alkalinity to an environmentally acceptable level. Even continuous processes which recycle, filter and replenish the bleach solution, as taught in the aforementioned co-pending application Ser. No. 312,637, must eventually dump spent bleach solutions and, therefore, must take steps to reduce alkalinity prior to dumping.

Notwithstanding that aqueous hydrogen peroxide solutions are acidic, bleaching in acid peroxide solutions is not practiced, it being the common belief that the ability of peroxide solutions to bleach decreases with decreasing alkalinity. Since conventional alkaline peroxide bleaching methods typically require extended periods of immersion in the bleach solution, the prospect of using still weaker acid peroxide bleach solutions for even longer bleach times, with attendant weakenging or tearing of the goods due to the acid, has been sufficient to preclude any efforts at acid peroxide bleaching. Thus, there are no viable acid peroxide bleach systems known today.

It is, therefore, an object of the present invention to provide a method of bleaching cotton greige goods in acid or neutral aqueous hydrogen peroxide bleach solutions.

It is another object of the invention to provide a method for bleaching cotton greige goods wherein spent bleach solutions can be discarded in an economic and environmentally acceptable manner.

It is still another object of the invention to provide a method for simultaneously scouring, desizing and bleaching cotton greige goods to commercially acceptable standards in acid or neutral aqueous hydrogen peroxide bleach solutions in less than about 15 to 30 minutes.

It is yet another object of the invention to provide an acid peroxide bleaching method which can achieve commercially acceptable whiteness standards in times of less than about 7 minutes.

Other objects and advantages will become apparent from the following description and appended claims.

Briefly stated, the aforesaid objects are accomplished in a bleach method which comprehends, in one embodiment, the simultaneous scouring, desizing and bleaching of cotton greige goods by immersing the goods in an aqueous hydrogen peroxide solution having a pH in the range 2 to 7, a temperature in the range from about 100° to 212° F, preferably 160° to 212° F, and a hydrogen peroxide concentration by volume of from 3 to 70%, the solution being substantially free of heavy metal ions and maintained out of contact with all metals while the goods are immersed herein. The bleach solution is recycled, filtered or purified, and replenished as necessary. Following bleaching, the goods are rinsed and dried in the conventional manner. The entire scouring, desizing and bleaching process can be accomplished in less than 15 to 30 minutes and, in a preferred embodiment, in less than 7 minutes. In other embodiments of the invention, the process can be accomplished still more rapidly or the goods can be bleached to an enhanced whiteness, by preceding the acid peroxide bleach with a rapid alkaline scour bath or with extremely rapid separate acid and alkaline scour baths.

It has been found, contrary to generally accepted notions, that acid peroxide bleaching can be accomplished in very short periods of time with no damage to the goods and in an economical and environmentally acceptable manner. Among the many advantages of acid peroxide bleaching over conventional alkaline peroxide bleaching are that: stock hydrogen peroxide solutions (without further additions thereto) can be used, thus eliminating foaming problems inherent in forming peroxide-alkali admixtures; acid peroxide bleaching is sufficiently exothermic in high peroxide concentrations to reduce the amount of energy which must be furnished to the system; spent acid peroxide bleach solutions can either be dumped directly into waterways or can be made acceptable for dumping by simple heating to produce oxygen and water; the fumes normally produced during alkaline peroxide bleaching which are deleterious to health and which pollute the air are avoided.

The foregoing and other objects and advantages of the present invention will become more readily apparent from the following description considered in conjunction with the accompanying drawings, in which.

Figure 1:
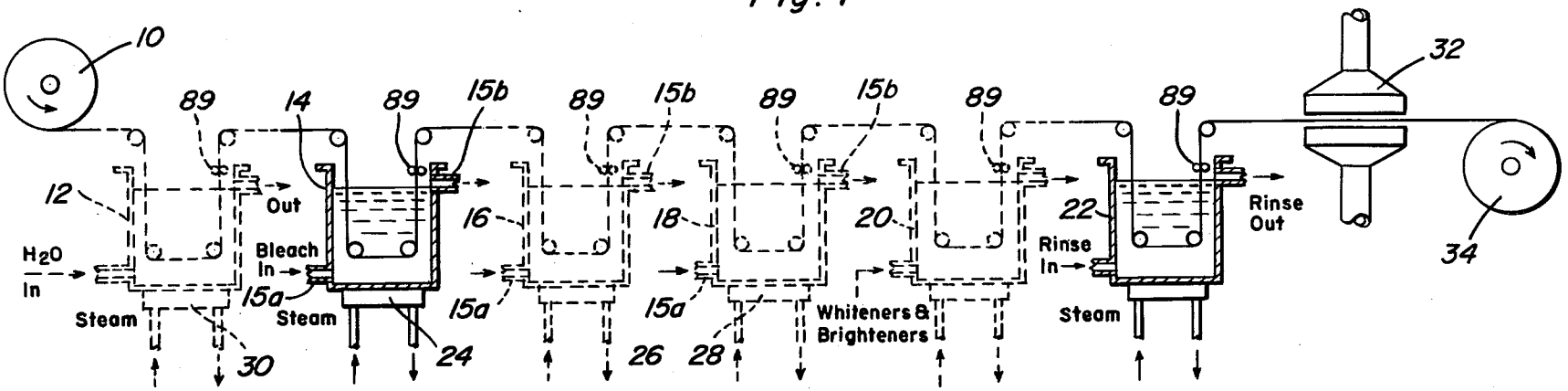
FIG. 1 is a schematic diagram illustrating a preferred bleaching method in accordance with the present invention, with optional steps shown in phantom.

Referring particularly to FIG. 1, the cotton greige goods to be bleached are fed off a roll 10 into and through a series of solution containing tanks or containers 12, 14, 16, 18 20 and 22. These containers may be of any structural material provided only that the portions thereof in contact with the solutions are of a non-metallic material. Glass or glass-lined metallic containers are suitable as are containers made of plastic materials, such as hard polypropylene.

The goods are passed from roll 10 into the bleaching, scouring and desizing solution which is contained in bleach container 14 and, optionally, additional bleach containers 16 and 18. The bleaching solution is circulated to and from each of these containers, preferably through a continuously or intermittently operating recirculating system which will be described hereinafter in connection with FIG. 2. Each of the bleaching containers is non-metallic, at least on the surfaces thereof that contact the bleaching solution. In one preferred form of the invention, the goods are passed to the first of three bleaching, scouring and desizing tanks or containers 14, through tank 14 and into tank 16, through tank 16 and into tank 18. The temperature of the solution in each of tanks 14, 16 and 18 is maintained within the desired range by heaters 24, 26 and 28, which may be steam operated heat exchangers. If desired, the goods may, prior to entering tank 14, be passed through a water dip tank 12 for periods up to 3½ minutes, which tank may contain tap, distilled or deionized water with the only limitation being that the water in the tank is substantially heavy metal ion free. Preferably the water in tank 12 is maintained at an elevated temperature above room temperature and between about 104° and 212° F by heater 30, which may be a steam operated heat exchanger. Dipping of the goods into the water in tank 12 serves to remove some of the impurities known to be present on and in the cotton greige goods and thereby reduces the subsequent contamination of the bleaching solutions by these impurities. In addition the water dip in tank 12, if used, brings the cotton goods up from ambient to the bleaching temperature. It will be appreciated that while the water pre-dip will remove some of the impurities on the goods, it will remove nowhere near the amount typically removed in the intensive scouring steps of the prior art. On the other hand, those impurities which are removed in tank 12 are prevented from entering the bleaching solution which, as is now well known, rapidly becomes contaminated with impurities from the cotton goods which turn the solution yellow and diminish the whiteness of the bleached goods. The total bleaching time in accordance with the present invention varies between one-half and 30 minutes depending on other process parameters, and is reduced somewhat if the water dip in tank 12 is utilized. The rate of travel of the goods through the tanks may be adjusted so that when more than one bleach tank is used the sum of the contact time with the bleach solution in each tank is sufficient to provide the total desired bleaching time.

After passing through the final bleach tank 18, the goods are passed through a rinsing tank 22 through which rinse water is circulated, and are then dried in a drier 32 which may be of a heated air-flow type. Finally, the goods are wound on a pickup reel 34. Alternatively, the goods may be continuously fed to the next process stage such as dying or cutting into pieces for further manufacture. If desired, the goods which exit bleaching tank 18 may be further whitened and brightened by passage through tank 20 to which are continously fed blueing, optical brighteners, and the like, all as are well known in the art to further whiten and brighten the goods. Alternatively, but less desireably, the whiteners and brighteners may be added directly to one of the other solutions used in the process.

Figure 2:
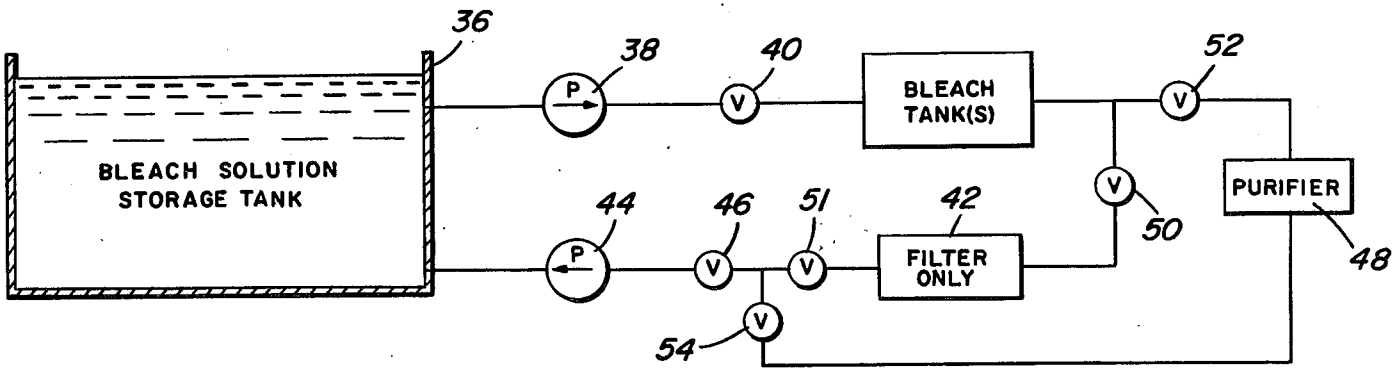
FIG. 2 is a schematic diagram in block form illustrating how the bleaching solution is continuously or intermittently recycled in the method illustrated in FIG. 1.

Inasmuch as the scouring, desizing and bleaching processes carried on in each of the tanks, even if pre-dip tank 12 is employed, results in some impurity contamination of the bleach solutions, with resulting yellowing, the system shown in FIG. 2 may be used on a continuous or intermittent basis for recirculating and reusing the bleach solutions and by avoiding continuous dumping, for achieving pollution control. The bleach solution is stored in a storage tank 36 to which additional solution may be added to make up for evaporation and depletion, to maintain peroxide concentration, and to maintain an adequate pH. Automatic sensors may be used to provide for the introduction of makeu-up solution so as to maintain proper bleaching solution strength (in terms of peroxide content) and pH. In one form the solution is pumped by means of a pump 33; the pressure and flow of the solution being controlled by a valve 40. The valve 40 is connected by piping to the inlet pipes **15*a* of each of the tanks 14, 16, and 18. The outlet pipes 15*b* from the tanks then are connected together and are piped via open valve 50 to a filter 42 which may be a mechanical filter such as a fiber or plastic screen or may be a microporous membrane. Sufficient back pressure is maintained by another pump 44 and a control valve 46. The filtered solution returns to the storage tank 36 to complete the recirculation system. After a period of use, the filter 42** may be cleaned and filtrate removed to a precipitating tank without polluting the environment in any way whatsoever.

In another embodiment of the invention, bleaching tanks 16 and 18 are not employed, nor is pre-dip tank 12. In this embodiment, all of the impurities present in the cotton greige goods contaminate the bleach solution per se and its effectiveness rapidly depletes. Mere filtration alone to remove solid impurities is insufficient to maintain the effectiveness of the solution. In such a case, the system shown in FIG. 2, with the addition of a purifier 48 through which the bleach solution is continuously or intermittently circulated is employed to remove the impurities from the contamined bleach solution. When used, open flow control valves 52 and 54 direct the flow through the system and valves 50 and 51 are closed. On the other hand, when purifier 48 is to be bypassed, valves 52 and 54 are closed and valves 50 and 51 are opened. Purification can be accomplished by distillation, reverse osmosis or adsorption by polymer adsorbants, by a combination of such methods, or by any known purification techniques to remove dissolved and suspended solids and oils. Although purification is necessary in many cases, as a general matter it is not desirable because purifying the peroxide solution destroys all components thereof, returning only pure water to the storage tank. Thus, the quantity of hydrogen peroxide which must be replenished to the system is quite large by comparison with a bleach system which employs a plurality of bleaching tanks and utilizes only filtration in lieu of purification. In connection with the latter type of system, it is noteworthy that the peroxide concentration in each of the bleach tanks, 14, 16 and 18 need not be the same. In fact, it is particularly desirable that the peroxide concentration be highest in the first bleach tank 14 in order that the major proportion of the impurities can be removed in this tank.

The following methods may be used to provide hydrogen peroxide which is substantially free of heavy metal ions:

Hydrogen peroxide can be made in a pure form essentially free of heavy metal ions by oxidizing in the liquid phase isopropyl alcohol or another secondary alcohol having 3 to 6 carbon atoms with oxygen or a gas containing oxygen at a temperature between 80° C and 160°

C under a pressure which is at least sufficient to allow the alcohol to remain in the liquid phase as described in U.S. Pat. 3,592,776, Fletcher et al, issued July 13, 1971. Since in this method the only catalyst used is hydrogen peroxide itself or a non-metalic free-radical producer such as azobisisobutyronitrile, the reaction starting materials are essentially free of heavy metal ions. Thus the hydrogen peroxide produced can be easily purified and concentrated by distillation with reduced danger of explosion.

Alternatively, suitable hydrogen peroxide may be purchased commercially as ACS reagent grade 30% designated 0004 HP 30 by Shell Oil Co. The following table gives the approximate analysts of this hydrogen peroxide:

TABLE

| | BAKER #2186 |
|---|---|
| Assay ($H_2O_2$) | 31.4% |
| Iron (Fe) | 0.00002% |
| Heavy Metals (as Pb) | 0.00003% |
| Ammonium ($NH_4$) | 0.0005% |
| Sulfate ($SO_4$) | 0.0002% |
| Phosphate ($PO_4$) | 0.00007% |
| Nitrate ($NO_3$) | 0.00007% |
| Chloride (Cl) | 0.0001% |
| Free Acid (as $H_2SO_4$) | 0.0004% |
| Residue after evaporation | 0.0006% |

In the event that organic impurities boiling at a higher temperature than $H_2O_2$ are present, they can be removed by counter-current, continuous, liquid-liquid extraction methods as described in U.S. Pat. No. Re. 25,114, original U.S. Pat. No. 2,949,343 by Hood et al.

Another hydrogen peroxide which can be used is also commercially available from the Shell Oil Co., as their 30% electronic grade which has the following analysis: Heavy Metal (as Pb) — 0.001%; Iron (as Fe) — 0.00005%; Silicon — 0.00005%; Nickel — 0.000002%; Chromium — 0.000002%.

The aforementioned Fletcher patent uses a method of reacting the $H_2O_2$ with urea to form a $H_2O_2$ urea adduct that can be easily precipitated from the reaction mixture and reacted with a extracting solvent such as acetone that decomposes the adduct and precipitates the urea. This leads to a solution of $H_2O_2$ in acetone that is extracted with more acetone and finally the acetone is removed by distillation.

The sodium hydroxide or the akaline additive used to raise pH is also substatially free of heavy metal ions. For example, ACS, Reagent grade NaOH; Fisher Scientific Catalog #S-318 is suitable. This certified ACS NaOH contains 0.0003% iron.

One great advantage of acid peroxide bleaching is that stock solutions can be employed. The following tabulation sets forth the pH of readily available stock solutions of substantially heavy metal ion free hydrogen peroxide:

| % by Vol. $H_2O_2$ | pH |
|---|---|
| 3 | 6.34 |
| 7.5 | 6.13 |
| 10 | 5.9 |
| 15 | 5.5 |
| 30 | 3.0 |
| 50 | 2.5 |
| 70 | 2.0 |

As will be appreciated, there are a number of variables in the process of the present invention, e.g., bleach time, hydrogen peroxide concentration, pH of bleach solution and temprature of bleach solution. Surprisingly, it has been found that satisfactory whiteness can be achieved using concentrations of hydrogen peroxide in the range from 3% to 70% by volume; bleach solution pH in the range from 2 to 7; bleach solution temperatures in the range 100° to 212° F, preferably 160° F to 212° F; and bleach times up to 30 minutes. It is particularly desirable to accomplish simultaneous scouring, desizing and bleaching in periods of time not exceeding about 3 ½ minutes. To accomplish this the pH should be maintained in the range 6 to 7, temperatures should be in the range 160° to 212° F and hydrogen peroxide concentrations should be 10 to 50% by volume. Of course, it will be appreciated that such rapid scouring, desizing and bleaching is achieved at the expense of increased peroxide concentration and increased temperature and this embodiment of the process is relatively costly in its energy and chemical requirements. Probably the greatest advantage of the embodiment of the process is that it permits bleaching to be accomplished at or near neutral pH, thus eliminating the need for expensive treatment of spent bleach solutions prior to sumping.

In another preferred embodiment of the process, bleaching is accomplished in the pH range 2 to 3 at temperatures of 195° F to 212° F and at hydrogen peroxide concentrations of 30 to 70% by volume. Under these conditions, commercially acceptable whitenesses, as will be defined hereinafter, are attainable in less than about 7 minutes. However, the real advantage of this embodiment is that it permits the use of stock solutions with no need for alkaline additions to adjust pH. Thus, foaming problems due to the reaction between alkali and hydrogen peroxide are avoided and the bleach solution is extremely stable. Moreover, bleaching solution depletion due to reaction with alkali is avoided with an attendant savings in chemical costs.

In still another embodiment, bleaching is accomplished in the pH range 6.0 to 7 at temperatures of 100 ° to 150° F and peroxide concentrations of 30 to 70% by volume in times of 30 minutes or less.

In order to take maximum advantage of the energy savings incident to this embodiment and to bleach at temperatures below 120° F, the peroxide concentration and pH must be adjusted to increase the bleaching power of the solution. Thus, to operate at or below 120° F it is recommended that the peroxide concentration should be at least about 40% at pH's in the range 6.7 to 7. Aternatively, at or below 120° F, the suitable pH range may be broadened to 6.5 to 7 by increasing the peroxide concentration to at least about 50% by volume. The following tabulation illustrates this embodiment.

| BLEACH | | | | |
|---|---|---|---|---|
| $H_2O_2$ (% by Vol.) | pH | Temp. (° F) | Time (Min.) | BASE WHITE |
| 30 | 6.4 | 150 | 15 | 73 |
| 30 | 6.4 | 150 | 30 | 78 |
| 30 | 6.75 | 112 | 30 | 70 |
| 30 | 6.75 | 122 | 30 | 71.5 |
| 30 | 7.0 | 150 | 30 | 78.5 |
| 40 | 6.75 | 100 | 30 | 72.5 |
| 40 | 6.75 | 150 | 10 | 78.5 |
| 50 | 6.5 | 100 | 30 | 73 |

One generally accepted measure of the success or extent of bleaching is measurement of the resulting fabric "base white" which can be defined as the whiteness of a piece of fabric after it has been bleached but prior to bluing or optical brightening. Whiteness is measured in terms of percentage reflection compared to some standard of pure white, such as MgO, $BaSO_4$ or Vitrolite, with respect to a source of light. The source is monochromatic and is impinged upon and reflected from the sample. Using a prism or grating, the reflected light is divided into its various components and its intensity is measured by a photocell. The comparative intensity is expressed as a percentage of the intensity of the reflection from the standard. Thus, it will be appreciated, that no matter how much a fabric has been bleached, it will never achieve a pure white shade. Its base white is always less than 100 and, in fact, its reflected color is always a shade of yellow.

The whiteness of a fabric (although not its "base white") can be increased by neutralizing the reflected yellow. Since blue is the complement of yellow, the addition of a blue dye to the fabric neutralizes the yellow while at the same time absorbing light striking it. The result is an increase in the whiteness (i.e., a decrease in the yellowness) but an over-all darkening of the color. On the other hand, fluorescent whiteners absorb light mostly in the ultraviolet region and emit blue fluroescence. The blue fluorescense neutralizes the yellow and increases the whiteness of the fabric. However, there is no over-all darkening attending use of fluorescent whiteners since their absorption is primarily in the ultraviolet region and not in the visible region. In fact, as long as too much whitener is not used the effect is to increase the apparent whiteness of the fabric. As a consequence, it has been found that by a proper balance of blueing and flourescent whiteners, a considerable whitening of the fabric can be accomplished.

The amount of whiteness desired in bleached fabric depends upon the ultimate intended usage of the fabric. Thus, if the fabric is to be color dyed, it is of no real consequence that its base white is somewhat lower than that of fabric which is not to be dyed. Generally speaking, commercially acceptable base whites are in the range 65 to 80. However, there is another aspect to commercially acceptable bleaching. Due to the presence of cotton husks or other particulate impurity matter in the unbleached, uncombed greige goods, it is possible to bleach the bulk of the cloth to a whiteness exceeding 65 while not successfully bleaching a substantial number of these particulate impurities, with the result that the cloth appears white but contains unbleached specks therein. From a practical viewpoint, a few unbleached specks per 12 × 12 inches section of fabric are commercially tolerable because they are relatively unnoticeable and because subsequent whitening and brightening will probably remove the specks. Therefore, when commercially acceptable whitenesses or commercially acceptable bleaching is referred to herein it means a whiteness of at least 65 with no more than a few specks per 12 × 12 inches cloth section.

Thus, in accordance with the present invention, a number of fabric samples were simultaneously scoured, desized and bleached in hydrogen peroxide solution with the result that commercially acceptable base whites were achieved within the hereinbefore defined pH temperature, concentration and bleach time limitations of the instant methods.

The following examples are illustrative of the present invention.

EXAMPLE I

A number of aqueous hydrogen peroxide bleach solutions having various pH levels, all of which are substantially free of heavy metals ions, were prepared at concentration levels ranging from 3% to 50% by volume hydrogen peroxide. Samples of cotton greige goods were immersed in these solutions in glass-lined containers after which each sample was rinsed and dried and base white readings made thereon. The following Table I summarizes the bleach conditions and the resulting base whites:

TABLE I

| BLEACH | | | | |
|---|---|---|---|---|
| $H_2O_2$ % by Vol. | Temp. (° F) | pH | Time (Min.) | BASE WHITE |
| 3 | 212 | 3.0 | 15 | 72.5 |
| 10 | 212 | 3.0 | 3½ | 69 |
| 10 | 212 | 6.9 | 3½ | 74 |
| 30 | 212 | 3.0 | 7 | 73 |
| 30 | 212 | 6.9 | 1½ | 76.1 |
| 30 | 167 | 6.9 | 7 | 72.9 |
| 50 | 212 | 2.5 | 1 | 74 |
| 50 | 195 | 2.5 | 3½ | 73.4 |
| 50 | 212 | 6.5 | ¾ | 79.5 |
| 50 | 110 | 6.9 | 20 | 71 |

Figure 3:
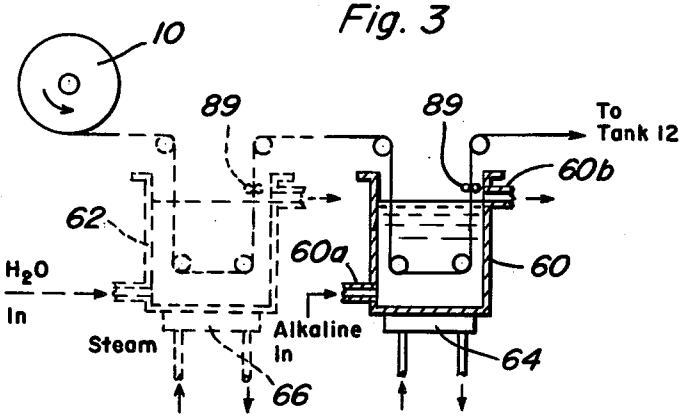
FIG. 3 illustrate the method of FIG. 1 utilizing an alkaline scour prior to bleaching with optional steps shown in phantom.

Referring now to FIG. 3, in another form of this invention an aqueous alkaline scour bath having a pH maintained in the range 10 to 14 and a temperature in the range 160°-212° F is employed preliminary to bleaching. It has been found that the addition of a short alkaline scour pre-treatment decreases the bleach time; permits the use of a single bleach bath without the need for bleach bath purification; reduces the amount of peroxide used to oxidize the colorants in the cloth; and avoids weakening the cloth by extended bleach baths. However, pre-scour treatments are not always desireable and particularly are not necessary where strong peroxide bleach solutions are employed. For example, referring to Table I, last entry, wherein a very white result is achieved in only about 45 seconds in the simultaneous process, the bleach solution identified there is much too strong to warrant a pre-scour and any pre-scour would be wasteful and possibly harmful to the goods.

In this embodiment, the cotton goods from roll 10 are immersed in a continuous fashion in the alkaline scour bath contained in tank 60 for a period of time ranging from 5 seconds to 3½ minutes, preferably from 1 to 3 minutes. The alkaline bath may be any strong base which can furnish the desired pH levels, for example, the alkali and alkaline earth hydroxides, preferably KOH or NaOH due to their ready availability and low cost. If desired, an optional water pre-dip may be employed prior to alkaline scouring by passing the goods through tank 62 which contains water at a temperature from above room temperature to 212° F. The temperatures of the solutions in tanks 60 and 62 are maintained within the desired ranges by heaters 64 and 66, which may be steam operated heat exchangers. As with the bleach baths, the alkaline solution and water employed are all substantially free of heavy metal ions and the portion of tanks 60 and 62 in contact with the solutions therein are non-metallic. At the same time, the solutions are maintained out of contact with all metals while the goods are immersed therein. In one preferred embodiment, the alkaline pre-bath has a pH in the range 11.8 to 13.5, a temperature of 185° - 212° F and a time of immersion of 1 to 3 minutes. A useful base white can be achieved following this preferred alkaline scour by immersing the goods in hydrogen peroxide bleach solution for about 1 minute.

On economic balance, use of an alkaline scour renders the process more expensive than the hereinbefore described simultaneous scouring, desizing and bleaching, since the alkaline scour process embodiment requires an additional hydroxide bath, associated monitoring equipment, and the like. On the other hand, the over-all process is rendered more economical by use of the relatively short alkaline pre-bath since bleaching time is reduced and the burden of removing colorants from the cloth falls upon the pre-bath not the bleach solution, and any need for purifying the bleach solution is eliminated with an attendant savings in energy and chemical costs.

Notwithstanding that the length of time the goods are immersed in the scour bath is short, such a bath is so efficient in removing contaminants that it yellows very rapidly and pollution control may be accomplished by intermittent or continuous recycling, replenishing and purifying the alkaline scour bath to remove the contaminants therefrom, while only filtering and replenishing the bleach bath. This accounts for a large savings in energy and a particularly large savings in the cost of peroxide chemicals.

In one optional form of the alkaline scour bath, the bath comprises a high pH hydrogen peroxide solution. In this manner, scouring is accompanied by oxidation and a very large proportion of the contaminants in the cloth are removed. Thus, the duration of the final bleach bath may be reduced to a comparatively short period of time and very little recycling and replenishing thereof is necessary. For example, in one continuous process, the scour bath may contain 1 to 10% by volume hydrogen peroxide at a temperature in the range 170° - 212° F and a pH of 10.75 to 14. Immersion in this bath for a period from 10 seconds to 2 minutes, preferably about 30 seconds, at pH 13.25 and 212° F in a 10% peroxide bath, followed by an optional rinse in water substantially free of heavy metal ions, and then followed by a 45 second to 3 minute bleach in 10 to 50% hydrogen peroxide at 170° - 212° F produces outstanding base whiteness.

Figure 5:
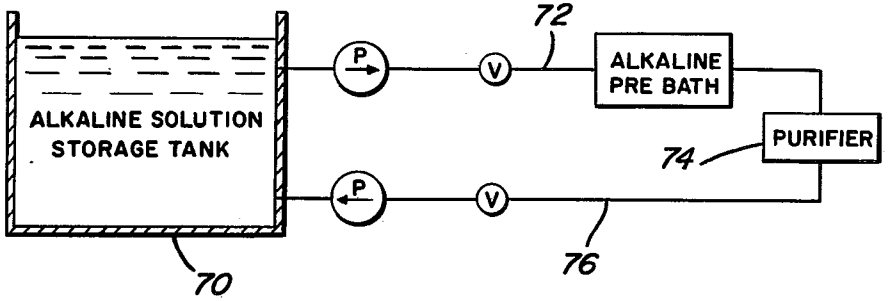
FIG. 5 is a schematic diagram in block form illustrating how the alkaline scour solution used in the methods of FIGS. 3 and 4 is continuously or intermittently recycled.

It is, of course, quite surprising in view of the prior art's requirement for extensive and prolonged scouring that scouring and desizing can be accomplished to such a substantial extent in about 1 minute followed by complete bleaching in times of about 1 minute. Particularly advantageous is that solution purification can be limited to the scour solution while bleach solution treatment can be accomplished largely by filtration and replenishment. As a result, the energy and chemical costs of such a system are less than any heretofore suggested. In this connection, reference is made to FIG. 5 where a system for recycling, purifying and replenishing the alkaline scour bath is shown. The alkaline scour solution is stored in tank 70 to which additional solution may be added to make up for evaporation and depletion, to maintain alkaline scour solution concentration, and to maintain an adequate pH. Automatic sensors may be used to provide for the introduction of make-up solution so as to maintain proper scour solution strength and pH. Pumps and valves are employed in a manner similar to that described in connection with FIG. 2 to control flow of the scour solution in the system. The storage tank outlet line 72 is connected to the inlet 60*a* of tank 60. The outlet 60*b* of tank 60 is piped through purifier 74 wherein dissolved and suspended solids, oils and the like impurities are removed and then through storage tank return line 76 to tank 70. It is believed that when the alkaline scour bath is continuously recycled, replenished and purified considerable scouring can be achieved in very short periods of time and the bleach times necessary are thereby much reduced. By removing the yellow coloring matter formed in the alkaline scour bath as fast as it is formed, a synergistic effect is noted which decreases the scour time by an unaccountably large factor and, at the same time, considerably decreases the bleaching time.

The following Examples are illustrative of the process employing an alkaline pre-scour.

EXAMPLE II

A number of aqueous hydrogen peroxide bleach solutions having various pH levels, all of which were substantially free of heavy metal ions, were prepared. Cotton greige goods samples were immersed in an alkaline scour solution at pH 14 and 212° F for the times indicated in Table II after which the samples were bleached, rinsed and dried and base white readings made thereon. The following Table II sumarizes the scour and bleach conditions and the resulting base whites.

TABLE II

| | SCOUR | BLEACH | | | | |
|---|---|---|---|---|---|---|
| | Time (Min.) | $H_2O_2$ (% by Vol.) | Temp. (° F) | pH | Time (Min.) | BASE WHITE |
| (a) | 3½ | 7.5 | 212 | 6.9 | 3½ | 79.6 |
| (b) | 3½ | 7.5 | 212 | 6.9 | 7 | 80 |
| (c) | 2 | 15 | 212 | 6.9 | 3½ | 78.5 |
| (d) | 1 | 30 | 167 | 3 | 7 | 72.5 |
| (e) | 1 | 30 | 212 | 3 | 3½ | 75.4 |

In order to compare the effectiveness of simultaneous scouring, desizing and bleaching with a bleaching process which includes an alkaline scour prior to bleach, the following tests were carried out.

EXAMPLE III

An aqueous hydrogen peroxide solution substantially free of heavy metal ions was prepared containing 10% by volume hydrogen peroxide at pH 6.9 and 212° F. A sample of cotton greige goods bleached therein for 3½ minutes exhibited a base whiteness of 74.

By comparison with the results of Table II (a) which includes a 3½ minute alkaline scour at 212° F and pH 14, it is apparent that the base whiteness was increased to 79.6 using the alkaline scour notwithstanding that the bleach solution contained 25% less hydrogen peroxide.

EXAMPLE IV

An aqueous hydrogen peroxide solution substantially free of heavy metal ions was prepared containing 10% by volume hydrogen peroxide at pH 6.9 and 212° F. A sample of cotton greige goods bleached therein for 7 minutes exhibited a base whiteness of 77.5.

By comparison with the result of Table II (b) which included a 3½ minute alkaline scour at 212° F and pH 14, it is apparent that the base whiteness was increased to 80 using the alkaline scour notwithstanding that the bleach solution contained 25% less hydrogen peroxide.

EXAMPLE V

The simultaneous scouring desizing and bleaching example of Example IV evidencing a base whiteness of 77.5 was compared with the base whiteness achieved using the alkaline scour plus bleach process of Table II (a) evidencing a base whiteness of 79.6. Both processes employed a total treatment time of 7 minutes although the scour-bleach process used only 3½ minutes for bleaching and the bleach solution contained 25% less hydrogen peroxide. Nevertheless, it is apparent that the scour-bleach process produced a superior result, showing the benefits to be achieved using an alkaline scour prior to bleaching.

EXAMPLE VI

An aqueous hydrogen peroxide solution substantially free of heavy metal ions was prepared containing 15% by volume hydrogen peroxide at pH 6.9 and 212° F. A sample of cotton greige goods bleached therein for 5½ minutes exhibited a good base whiteness. However, when the 5½ minute treatment time was broken down into a 2 minute alkaline scour at pH 14 and 212° F followed by a 3½ minute bleach in a solution containing 15% by volume hydrogen peroxide at pH 6.9 and 212° F, the base whiteness and overall result achieved was much superior than where the bleach solution was used without the alkaline scour.

Figure 4:
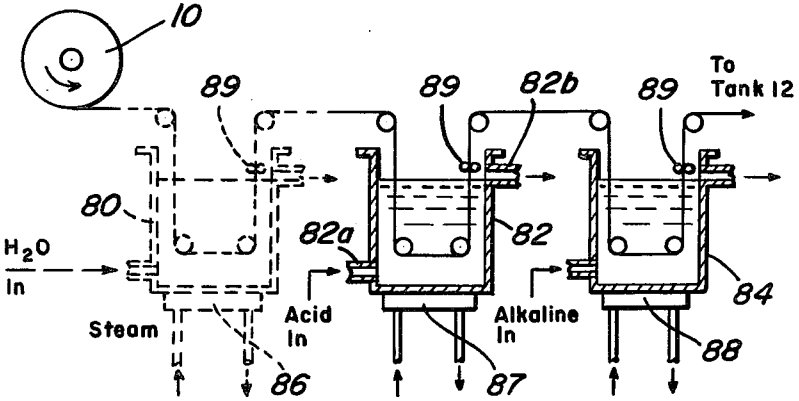
FIG. 4 illustrates the method of FIG. 1 utilizing separate alkaline and acid scours prior to bleaching, with optional steps shown in phantom.

Still another embodiment of the present invention is shown in FIG. 4 wherein an acid scour bath substantially free of heavy metal ions preliminary to the alkaline scour bath of FIG. 3 is employed to produce an instantaneous cracking of the sizing and chemical coatings of the fibers in the cotton greige goods. The effect is akin to a type of explosive hysteresis wherein the pH cycling in the scour baths causes the fibers to swell and contract and the oils, chemicals and coatings to be solubilized rather rapidly by the alternate contraction and swelling. In this manner, the contaminants on the goods are explosively removed from the fibers. As can be seen from FIG. 4, the cotton goods may first be moved from roll 10 to an optional water dip in tank 80 at a temperature from above room temperature to 212° F. Following the water dip if it is used or directly from roll 10, the cotton goods are immersed in tank 82 in an acid solution having a pH in the range up to about 3.0, desirably less than about pH 1, at a temperature in the range 45°–212° F for a very brief time from 1 to 10 seconds. Immediately upon exiting the acid bath, the goods are immersed in tank 84 containing an alkaline scour bath as has been previously herein described. The temperatures of the solutions in tanks 80, 82 and 84 are maintained within the desired ranges by heaters 86, 87, 88 which may be steam operated heat exchangers. It is the contractions and swelling caused by the alternating acid and base baths which cause the rapid, almost explosive, removal of contaminants from the cloth. Following the alkaline scour bath, and as has already been described, the goods move through an optional dip in water in tank 12 after which they are subjected to hydrogen peroxide bleaching. The bleach solution which is employed may be substantially the same as has hereinbefore been described. However, the great advantage of this embodiment of the process depicted in FIG. 4 is that bleaching is extraordinarily rapid and extraordinarily high whitenesses are achieved with practically no contamination whatever of the peroxide bleach bath. Thus, it is only necessary to minimally recycle, filter and replenish the hydrogen peroxide bleach bath and purification efforts can be limited to the acid and alkaline scour baths.

Figure 6:
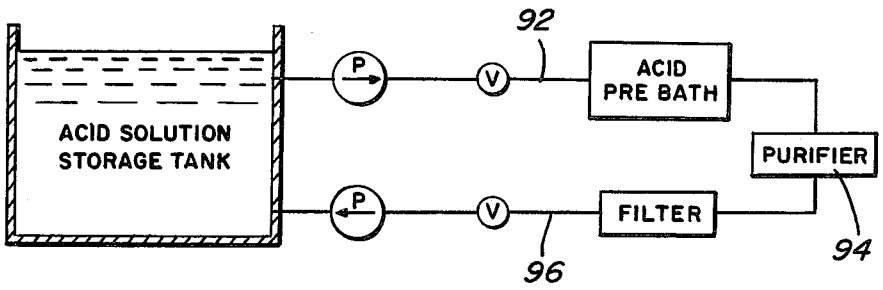
FIG. 6 is a schematic diagram in block form illustrating how the acid scour solution used in the method of FIG. 7 is continuously or intermittently recycled.

Thus, with reference to FIG. 6, there is shown the system which can be used to intermittently or continuously recycle, purify and replenish the acid scour bath. The acid scour solution is stored in tank 90 to which additional solution may be added to make up for evaporation and depletion, to maintain acid scour solution concentration, and to maintain an adequate pH. Automatic sensors may be used to provide for the introduction of make-up solution so as to maintain proper scour solution strength and pH. Pumps and valves are employed in a manner similar to that described in connection with FIG. 2 to control flow of the acid scour solution in the system. The storage tank outlet line 92 is connected to the inlet **82*a* of tank 82. The outlet 82*b* of tank 82 is piped through purifier 94 and then through storage tank return line 96 to tank 90. The system shown in FIG. 5 would, of course, be used to recycle, replenish, and purify the alkaline scour solution from tank 84**.

There is, of course, an additional cost factor incident to employing the acid bath. However, the surprising efficiency of the combined acid-alkaline scour baths in removing contaminants markedly reduces the bleach time and the waste of bleach chemicals and the attendant savings more than offsets the additional costs incident to the process. In addition, the whitest bleached cloths result from using the acid-alkaline scour. Moreover, total scour time is generally less than the scour time if only the alkaline bath is used and a 10 second acid-10 second alkaline scour can achieve results comparable to a 1 minute alkaline scour alone. Furthermore, bleach times are reduced by about 25% compared to the alkaline scour process embodiment with total pre-treatment and bleach times in the range 1 minute to 1½ minutes where high concentration, high acid pH and high temperature bleach solutions are used. It is also noteworthy that the order of the scour baths is unimportant and can be reversed and the alkaline scour can be accomplished prior to the acid scour.

It is preferred that the acid bath have a pH in the range less than 3 and preferably 0.5 to 1, a temperature in the range 45° to 120° F and more preferably 50° – 85° F, and a total immersion time of 1 to 10 seconds, preferably 1 to 5 seconds and usefully 0.5 to 3 seconds. Any strong acid can be used which can achieve these pH levels.

The following Examples are illustrative of the process employing separate acid and alkaline scour baths prior to bleaching.

EXAMPLE VII

A sample of cotton greige goods was immersed in a pH 14 alkaline scour bath at 212° F for 1 minute followed immediately by a pH 0.65 acid scour bath at 68° F for 5 seconds. The scoured goods were immersed in a 30% by volume aqueous hydrogen peroxide solution at pH 3 and 212° F for 1 minute. All solutions and baths were substantially free of heavy metal ions. The resulting goods evidenced a base whiteness of 80.2 for a total treatment time of only 2 minutes and 5 seconds.

By comparison, the same goods were treated under substantially the same conditions except that the acid bath was omitted and bleaching was continued for 3½ minutes as set forth in Table II (e). Notwithstanding that the total treatment time was 4½ minutes, more than twice as long, the base whiteness of the goods was only 75.4 indicating the great value of a brief acid scour.

Although it will be appreciated that the present process is effective for simultaneous scouring, desizing and bleaching of cotton greige goods over the broad parameter ranges indicated, and is effective with alkaline pre-scour and/or alkaline and acid pre-scours, the particular parameters selected depend to a large extent on the result desired. Moreover, since every cloth is different no hard and fast rules can be cited which will apply in all cases. In addition, some bleach solutions are easier to use than others — e.g., 70% by volume hydrogen peroxide is difficult to work with. Moreover, the 30%, 50% and 70% by volume baths can be heated above 212° F and are extremely active. Therefore, when working with such solutions at these high temperatures, pH and treatment times must be carefully controlled to avoid weakening the bleached goods to the point that they lose their tensile strength. If the bleach solution becomes too active, water jacketing of the bleach tank may be desirable. It is also noteworthy that as the pH of the bleach solution drops to about 3 or lower, alkaline scouring for more than about one minute should be avoided lest the goods lose their tensile strength.

As a general rule, at high peroxide concentrations and high temperatures, the rapid bleach solutions that produce very white base white goods do not gain significantly, from a time viewpoint, from any scour treatments. On the other hand, when lower concentrations of peroxide are used or where higher concentrations are used at low temperatures, there is a significant decrease in bleaching time as a function of the intensity of the scour treatments. The acid plus alkaline scour treatment prior to bleaching is the most effective pre-treatment when low pH bleach systems are used. Moreover, it should be appreciated that in cases where maximum base whiteness is the primary criteria, the acid plus alkaline scour treatment followed by bleaching is always most effective.

In moving the goods from bath to bath, in any of the processes described in connection with FIGS. 1, 3 or 4, it is desirable to preclude carry-over of solutions from tank to tank. The reason is obviously to prevent the solution in each succeeding tank from becoming contaminated by the solution from the preceding tank. This is particularly so because the concentration, temperature and pH of each solution, as has hereinbefore been noted, influences the efficiency of that solution for its particular task. Thus, utilizing FIG. 5 for descriptive purposes, it would be extremely undesirable to carry-over the low pH acid solution from tank 82 into the high pH alkaline solution in tank 84. Likewise, carry-over of high pH alkaline solution from tank 84 into neutral water-dip solution in tank 12 would adversely affect the pH of the solution in tank 12. For these reasons it is recommended that the goods pass through squeeze rollers 89 as they emerge from each solution, whereby the solution is forced from the goods and drips back into each tank.

Another problem associated with moving goods from tank to tank is that the goods tend to lose heat and reduce in temperature between the time they emerge from one solution and enter the next solution. Particularly where there is a relatively small solution to fabric ratio in the tank, the goods cause the solution in the tank to drop in temperature from the desired temperature, with attendant loss in operating efficiency. In part, optional water-dip baths in tanks 12, 66 and 86 serve to raise the fabric temperature and thereby to somewhat alleviate this problem. A better, albeit more costly solution, is to provide heated rollers (not shown) at the inlet to each tank and to cause the fabric to pass between these rollers prior to entering the solution in the tank. If the rollers are heated by steam, for example, their temperature can be controlled to correspond the temperature of the fabric to that of the solution it is about to enter.

While the present invention has been desribed with respect to particular embodiments thereof, it will be understood by those skilled in the art that numerous modifications can be made without actually departing from the invention. Accordingly, all modifications and equivalents may be resorted to which fall within the scope of the invention as claimed.

What is claimed as new is as follows:

1. A process for scouring, desizing and bleaching cotton griege goods comprising the steps of:

a. immersing said goods for a time sufficient to achieve commercial brightness but less than about 30 minutes in an aqueous solution having a temperature in the range from 112° to 212° F and consisting of from 3 to 70% by volume hydrogen peroxide, water and sufficient hydroxide to adjust said solution to a pH in the range 2 to 7, said solution being substantially free of heavy metal ions and maintained out of contact with all metals while said goods are immersed therein;

b. cycling a portion of said solution through a filtration means to remove solid impurities therefrom while maintaining the volume, composition and pH of said solution in contact with said goods substantially the same;

c. rinsing said goods with water to wash said aqueous solution therefrom; and d. drying said goods.

2. A process, as claimed in claim 1, wherein said aqueous solution includes 3 to 50% by volume hydrogen peroxide at 160° to 212° F, said goods being immersed therein for less than about 15 minutes.

3. A process, as claimed in claim 1, wherein said aqueous solution has a temperature in the range 160° to 212° F, a pH of 6 to 7, and includes 10 to 50% by volume hydrogen peroxide.

4. A process, as claimed in claim 3, wherein said goods are immersed in said solution for less than about 3½ minutes.

5. A process, as claimed in claim 1, wherein said aqueous solution has a temperature in the range 195° to 212° F, a pH of 2 to 3 and includes 30 to 70% by volume hydrogen peroxide.

6. A process, as claimed in claim 5, wherein said goods are immersed in said solution for less than about 7 minutes.

7. The process, as claimed in claim 1, wherein said process includes the steps of maintaining said solution in a plurality of containers and successively immersing said goods into the solution in different ones of said containers.

8. A process, as claimed in claim 7, wherein the portion of each of said containers in contact with said solution is glass.

9. A process, as claimed in claim 1, wherein said hydrogen peroxide is electronic grade.

10. A process as claimed in claim 1, wherein said water of said solution is selected from the group consisting of deionized and distilled water.

11. A process, as claimed in claim 1, wherein said solution further includes a fluorescent whitener.

12. A process as claimed in claim 1, wherein said process is continuous and said cycling is continuous.

13. A process, as claimed in claim 1, wherein said simultaneous scouring, desizing and bleaching is accomplished by immersing said goods in a single tank containing said solution and said cycled portion of said solution is continuously purified to remove contaminants therefrom.

14. A process, as claimed in claim 1, including the step of immersing said goods in water for up to 3½ minutes prior to immersing said goods in said hydrogen peroxide solution, said water having a temperature from just above ambient to 212° F and being substantially free of heavy metal ions and maintained out of contact with all metals while said goods are immersed therein.

15. A process, as claimed in claim 14, wherein said water temperature is in the range 104° to 212° F.

16. A process, as claimed in claim 1, including the step of immersing said goods in an alkaline scour solution for from 5 seconds to 3½ minutes prior to immersing said goods in said hydrogen peroxide solution, said alkaline scour solution having a temperature in the range 160° - 212° F and a pH from 10 to 14.

17. A process, as claimed in claim 16, wherein said goods are immersed in said alkaline scour solution for from 1 to 3 minutes.

18. A process, as claimed in claim 17, wherein said alkaline scour solution is in the range 11.8 to 13.5.

19. A process, as claimed in claim 18, wherein said alkaline scour solution temperature is in the range 185° to 212° F.

20. A process, as claimed in claim 16, wherein said alkaline scour solution contains 1 to 10% by volume hydrogen peroxide therein.

21. A process, as claimed in claim 16, wherein a portion of said alkaline scour solution is cycled through a purification means to remove impurities therefrom while maintaining the volume, composition and pH of said alkaline scour solution in contact with said goods substantially the same.

22. A process, as claimed in claim 16, including the step of immersing said goods in an acid solution for from 1 to 10 seconds prior to immersing said goods in said hydrogen peroxide solution, said acid solution having a temperature in the range 45° to 212° F and a pH less than about 3.

23. A process, as claimed in claim 22, wherein said acid solution pH is 0.5 to 1.

24. A process, as claimed in claim 22, wherein said solution temperature is in the range 45° to 100° F.

25. A process, as claimed in claim 22, wherein said goods are immersed in said acid solution for from 1 to 5 seconds.

26. A process, as claimed in claim 22, wherein a portion of said acid solution is cycled through a purification means to remove impurities therefrom while maintaining the volume, composition and pH of said acid solution in contact with said goods substantially the same.

27. A process, as claimed in claim 22, wherein said goods are immersed in said acid solution prior to being immersed in said alkaline scour solution.

28. A process, as claimed in claim 22, wherein said goods are immersed in said alkaline scour solution prior to being immersed in said acid solution.

29. A process, as claimed in claim 1, wherein said aqueous solution has a temperature in the range 100° to 150° F, a pH of 6.0 to 7, and includes 30 to 70% by volume hydrogen peroxide.

30. A process, as claimed in claim 29, wherein said aqueous solution includes 40 to 70% by volume hydrogen peroxide.

31. A process, as claimed in claim 29, wherein said solution temperature is above about 120° F.

32. A process, as claimed in claim 15, wherein said immersion time in said hydrogen peroxide solution does not exceed 3½ minutes.

* * * * *